US007857240B2

(12) United States Patent
Huang

(10) Patent No.: US 7,857,240 B2
(45) Date of Patent: Dec. 28, 2010

(54) ROTARY SHOWER HEAD

(76) Inventor: So Mel Huang, No. 289, Peng Yi Rd., Tai Ping City, Taichung (TW)

( * ) Notice: Subject to any disclaimer, the term of this patent is extended or adjusted under 35 U.S.C. 154(b) by 129 days.

(21) Appl. No.: 12/379,397

(22) Filed: Feb. 20, 2009

(65) Prior Publication Data

US 2010/0213289 A1 Aug. 26, 2010

(51) Int. Cl.
*B05B 3/04* (2006.01)

(52) U.S. Cl. ..... 239/237; 239/240; 239/263; 239/263.3; 239/381; 239/558; 239/587.4

(58) Field of Classification Search ..... 239/208, 239/209, 225.1, 232, 237, 239, 240, 246, 239/263, 263.3, 264, 282, 380–383, 448, 239/461, 463, 490, 504, 518, 552, 558, 587.1, 239/587.4

See application file for complete search history.

(56) References Cited

U.S. PATENT DOCUMENTS

| | | | | |
|---|---|---|---|---|
| 4,588,130 | A * | 5/1986 | Trenary et al. | 239/381 |
| 5,201,468 | A * | 4/1993 | Freier et al. | 239/383 |
| 6,896,201 | B1 * | 5/2005 | Ouyoung | 239/240 |
| 7,093,780 | B1 * | 8/2006 | Chung | 239/587.1 |
| 2006/0102747 | A1 * | 5/2006 | Ho | 239/383 |

* cited by examiner

*Primary Examiner*—Jason J Boeckmann
(74) *Attorney, Agent, or Firm*—Rosenberg, Klein & Lee

(57) ABSTRACT

A rotary shower head for showering includes an outer case to house a universal joint, an inner case assembly, a driving mechanism and a water discharge disc. Water entering the shower head provides a water discharge force to thrust the driving mechanism to generate automatic turning of the water discharge disc to achieve water-saving effect.

6 Claims, 5 Drawing Sheets

ROTARY SHOWER HEAD

BACKGROUND OF THE INVENTION

1. Field of the Invention

The present invention relates to a rotary shower head and particularly to a water-saving shower head.

2. Description of the Prior Art

Shower head, as the one shown in FIG. 1, is commonly used by people to save water in shower. It generally has a water discharge tray 1 with a plurality of water outlets 11 formed thereon to spray water while users are taking shower. To save water some shower heads have the water outlets 11 formed at a smaller size or with a fewer number. Such approaches have shortcomings in practice, notably:

1. The water outlets 11 of a smaller size or fewer number produce less powerful water ejection or a smaller water covering area, hence give users non-thorough cleaning feeling. Users tend to increase showering time to compensate this deficiency. As a result, instead of water saving, more water consumption and waste occur.

2. The water outlets 11 of a smaller size are easily clogged by impurities in the water.

SUMMARY OF THE INVENTION

In view of the aforesaid problems, the present invention aims to provide a rotary shower head which has an outer case housing a universal joint, an inner case assembly, a driving mechanism and a water discharge disc. Water discharge thrusts the driving mechanism to generate automatic turning of the water discharge disc. Therefore a greater water spraying area is generated, and water-saving effect can be achieved.

DESCRIPTION OF THE PREFERRED EMBODIMENT

Figure 1:
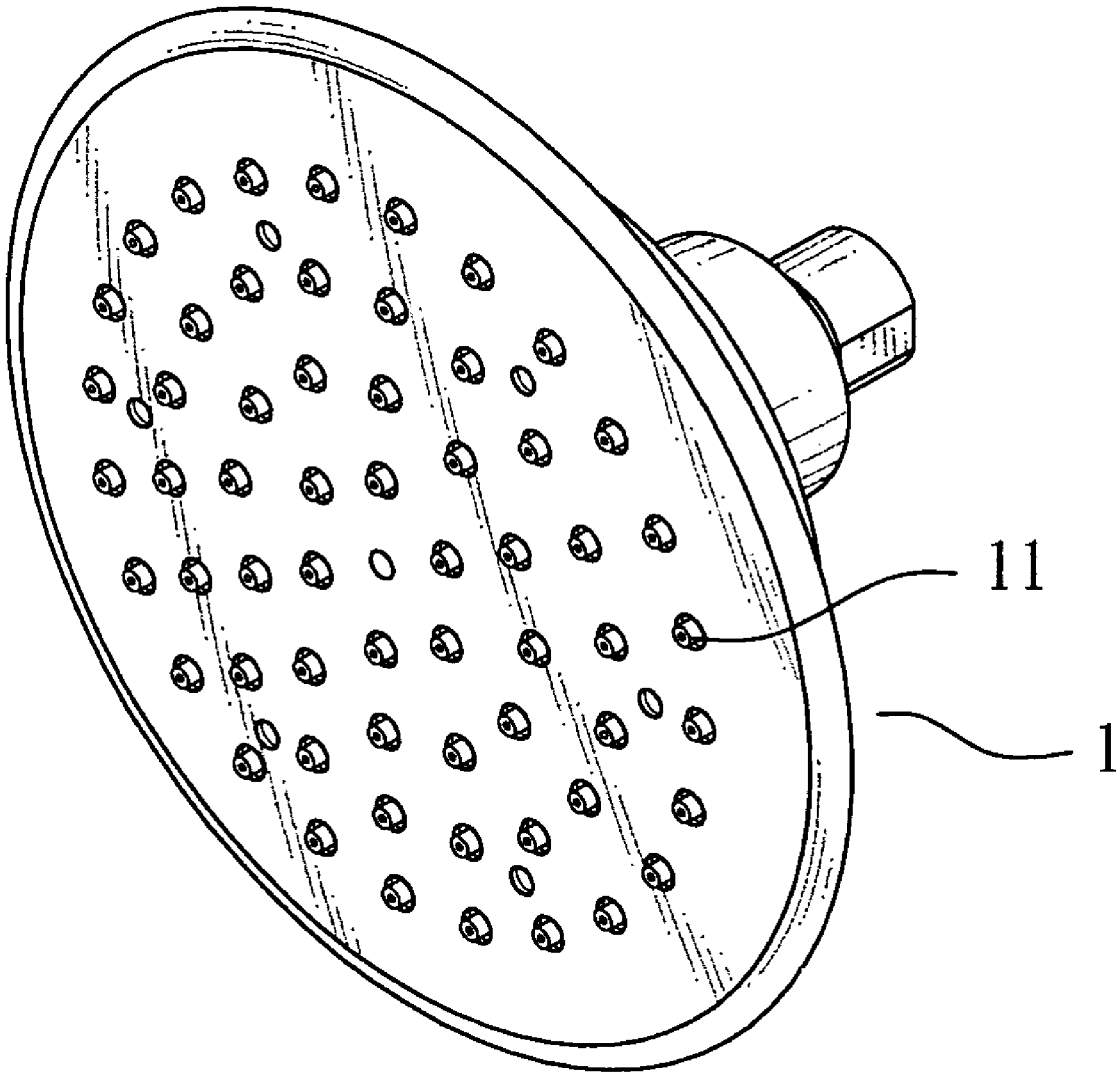
FIG. 1 PRIOR ART
FIG. 1 is a schematic view of a conventional shower head.
Figure 2:
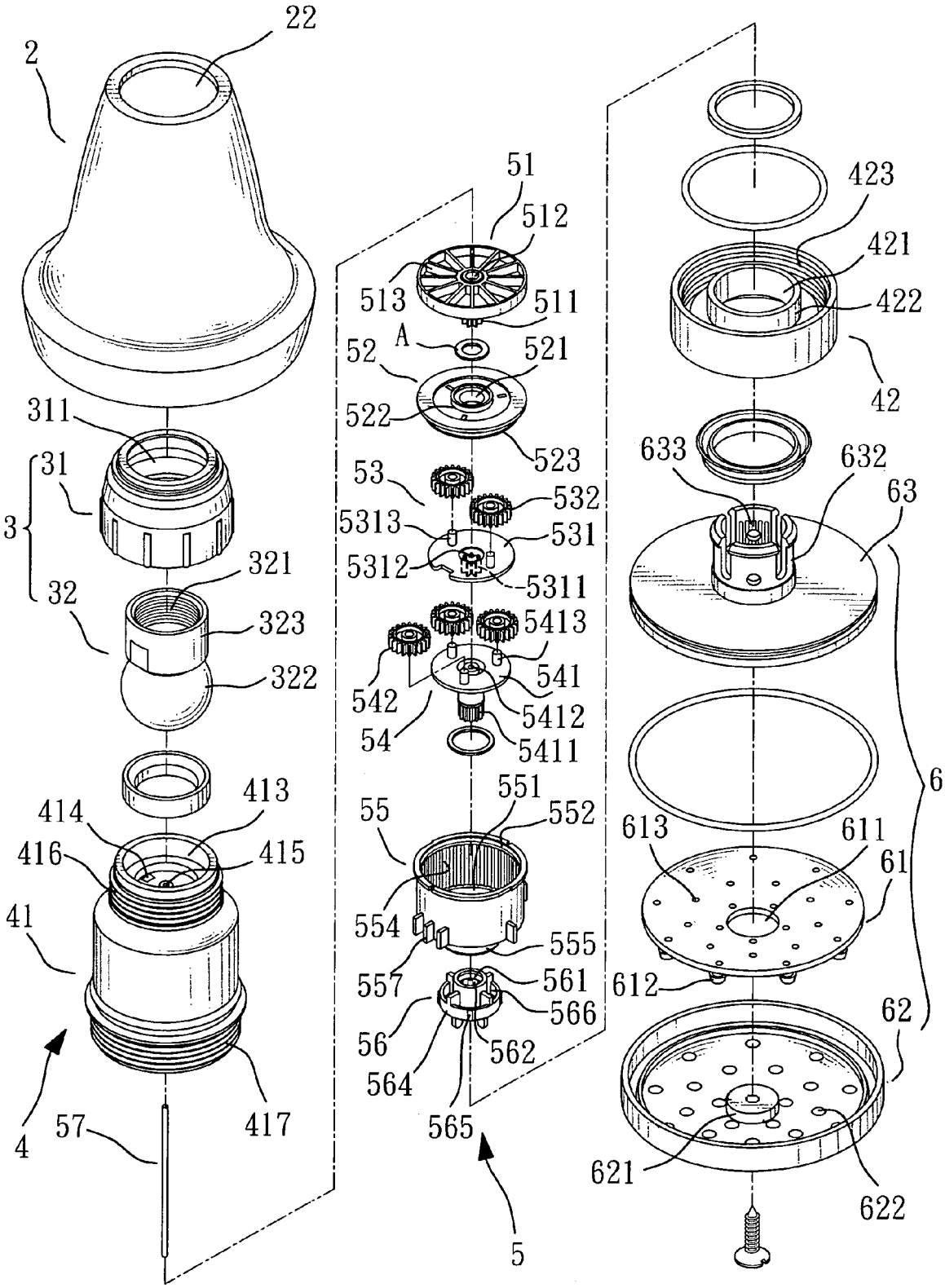
FIG. 2 is an exploded view of the invention.
Figure 3:
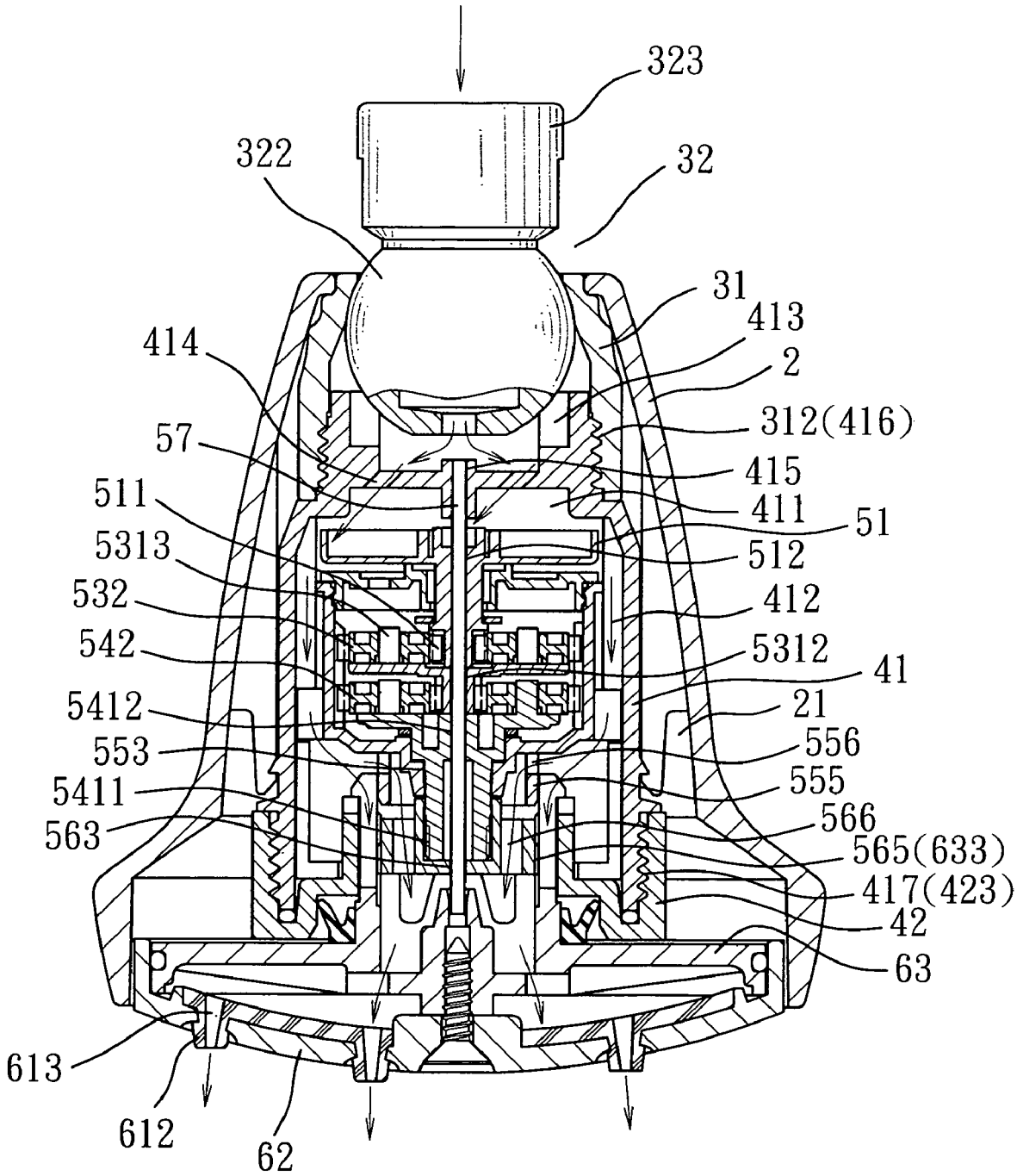
FIG. 3 is a sectional view of the invention.
Figure 4:
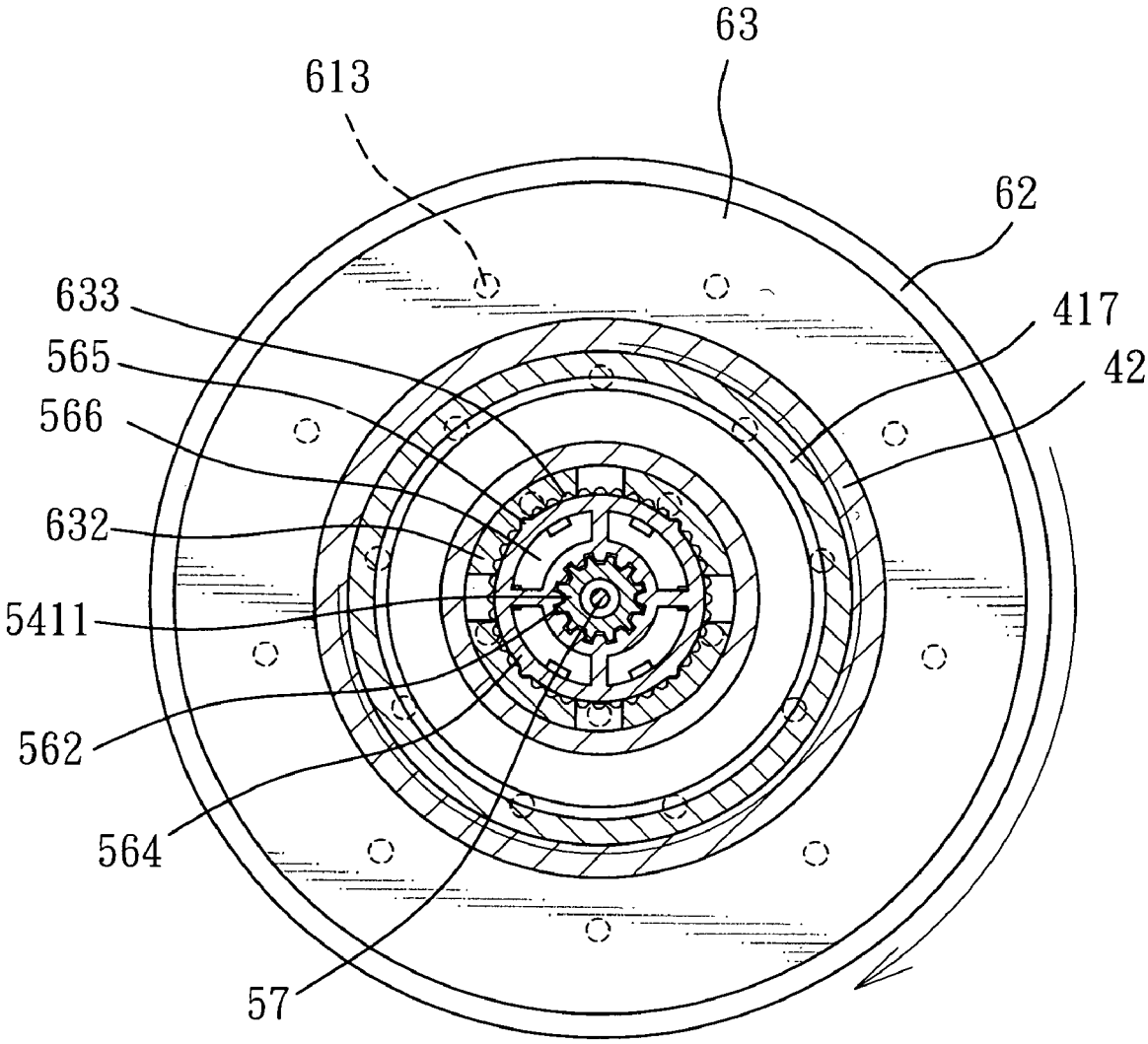
FIG. 4 is a cross section of an embodiment of the invention.
Figure 5:
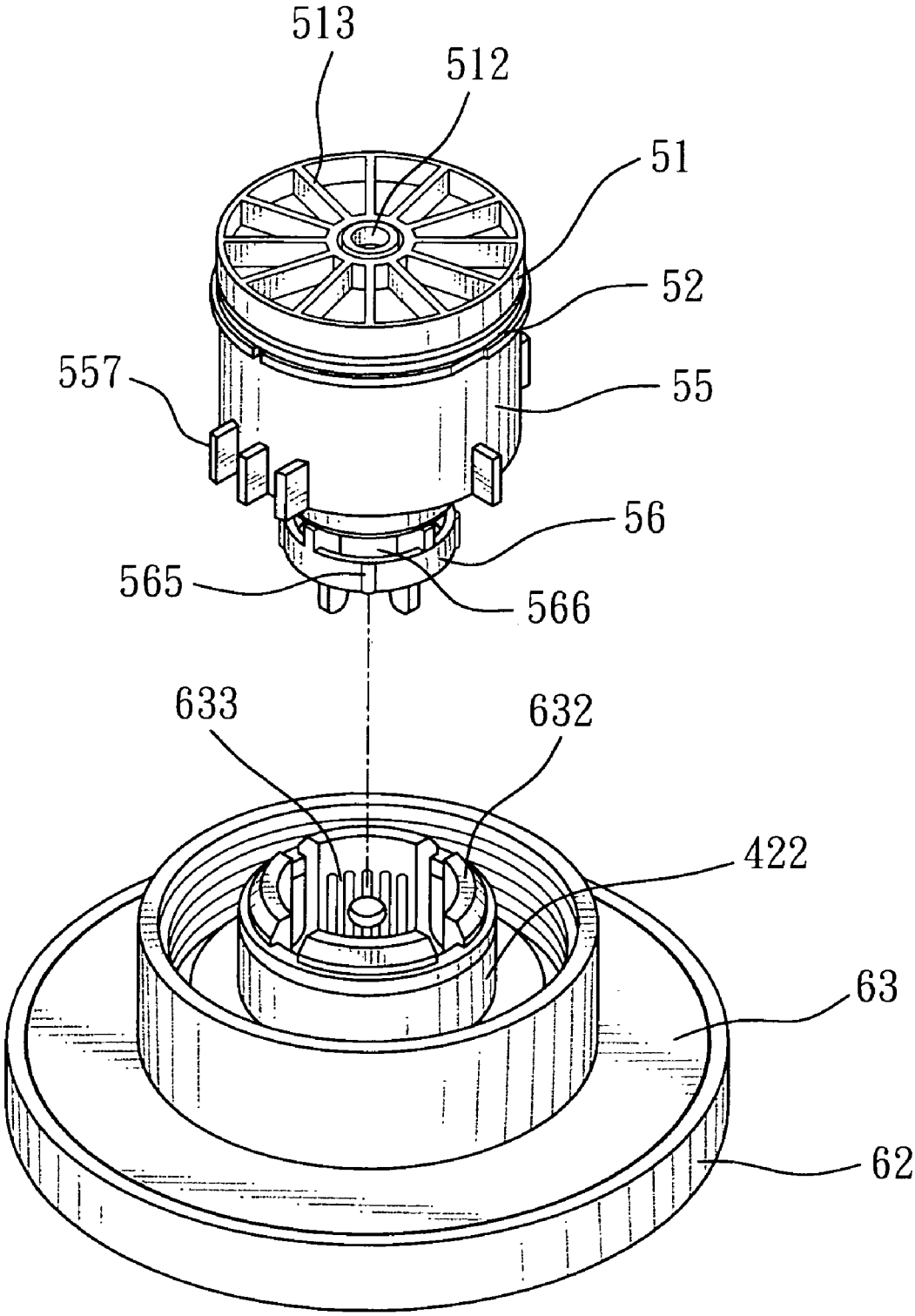
FIG. 5 is a fragmentary exploded view of an embodiment of the invention.

Please referring to FIGS. 2, 3 and 5, the present invention aims to provide a rotary shower head which includes an outer case 2 to house a universal joint 3, an inner case assembly 4, a driving mechanism 5 and a water discharge disc 6.

The outer case 2 has a housing chamber 21 to hold the following elements and an opening 22 at a top end thereof.

The universal joint 3 includes:

a cap 31 which has an aperture 311 with a first thread portion 312 formed on an inner side; and a ball seat 32 which has a body run through by a screw hole 321, and a ball 322 at one end and a first fastening section 323 at another end extended outside the aperture 311 of the cap 31 and the opening 22 of the outer case 2.

The inner case assembly 4 includes:

an upper case 41 which has a housing compartment 411 with an inner rim formed a plurality of retaining ribs 412, and a coupling portion 413 at one end to hold the ball 322 of the ball seat 32. The coupling portion 413 has at least one diagonal hole 414 and a first axle hole 415 at the bottom leading to the housing compartment 411. The coupling portion 413 further has a second thread portion 416 on an outer side fastenable to the first thread portion 312 of the cap 31. The upper case 41 also has a lower end formed a third thread portion 417 on the outer side; and a lower case 42 which has a through hole 421 in the center that has a jutting annular rib 422 on the circumference and a fourth thread portion 423 on an inner side fastenable to the third thread portion 417.

The driving mechanism 5 includes:

a rotary disc 51 which has a first gear shaft 511 extended form the center of the bottom and formed with a second axle hole 512, and a plurality of vanes 513;

an upper lid 52 which is held in the inner case assembly 4, and has a third axle hole 521 run through by the first gear shaft 511 and retained by a retaining ring A. The third axle hole 521 is surrounded by an annular flange 522 to hold the rotary disc 51. The upper lid 52 further has a first fastening portion 523 on the bottom side;

a first speed-reducing set 53 which includes a first bottom disc 531 and a plurality of first gears 532. The first bottom disc 531 has a second gear shaft 5311 extended downwards from the center of the bottom thereof and a fourth axle hole 5312 corresponding to the second axle hole 512. The first bottom disc 531 further has a plurality of first struts 5313 around the fourth axle hole 5312 to hold the first gears 532 to engage with the first gear shaft 511 of the rotary disc 51 to form chain movement;

a second speed-reducing set 54 which includes a second bottom disc 541 and a plurality of second gears 542. The second bottom disc 541 has a third gear shaft 5411 extended downwards from the center of the bottom thereof and a fifth axle hole 5412 corresponding to the fourth axle hole 5312. The second bottom disc 541 further has a plurality of second struts 5413 to hold the second gears 542 to engage with the second gear shaft 5311 to form chain movement;

a seat 55 which has a housing space 551 to hold the first and second speed-reducing sets 53 and 54, and a second fastening portion 552 at the top side to fasten to the first fastening portion 523 of the upper lid 52. The seat 55 also has a boss 555 at the bottom that has a sixth axle hole 553 run through by the third gear shaft 5411 of the second bottom disc 541. The housing space 551 has an annular gear rack 554 on an inner rim to engage with the gears 532 and 542 of the first and second speed-reducing sets 53 and 54. The boss 555 has at least one hole 556 formed on the periphery. The seat 55 further has a plurality of retaining lugs 557 formed on the perimeter corresponding to and latchable with the retaining ribs 412 of the upper case 41 so that the seat 55 can be retained as desired;

a rotary head 56 which has a coupling trough 561 in the center that has an internal gear rack 562 to engage with the third gear shaft 5411 to generate chain movement. The coupling trough 561 further has a seventh axle hole 563 at the bottom. The rotary head 56 also has an annular base 564 with at least one ridge 565 formed on the perimeter and a plurality of orifices 566 formed thereon; and an axle 57 running through the first, second, fourth, fifth and seventh axles 415, 512, 5312, 5412 and 563.

The water discharge tray 6 includes:

a pad 61 which has a hole 611 in the center and a plurality of jutting water discharge struts 612 each has a water outlet 613 running through;

a face disc 62 which has an anchor boss 621 in the center to couple with the hole 611 of the pad 61 and a plurality of coupling holes 622 mating and run through by the water discharge struts 612; and a bottom seat 63 which has a disc 631 and a transmission portion 632 in the center of the disc 631. The transmission portion 632 has a plurality of annular latch grooves 633 inside latched by the ridge 565 of the rotary head 56 to form chain movement.

Referring to FIGS. 2 through 5, by means of the structure set forth above, when in use water enters through the ball seat 32 into the coupling portion 413 of the upper case 41; the entering water passes through the diagonal holes 414 and generates a diagonal thrust force to drive the vanes 513 and turn the rotary disc 51; the entering water flows out through space at two sides of the rotary disc 51 so that the first gear shaft 511 also drives the first gears 532 of the first speed-reducing set 53 and the first bottom disc 531, and the second gears 542 of the second speed-reducing set 54 and the second bottom disc 541 and the third gear shaft 5411 also are driven to rotate, and consequently the bottom seat 63 also is driven to rotate. As a result the entire water discharge tray 6 rotates so that the water is discharged through the water outlets 613 of the water discharge struts 612 with moving spraying spots. The number of the water outlets 613 can be reduced (without shrinking the size thereof) to save water consumption, while the effective spraying area can be increased to enable users to take shower and get thorough cleaning of their bodies.

I claim:

1. A rotary shower head comprising an outer case which houses an universal joint, an inner case assembly, a driving mechanism and a water discharge disc, wherein:

the outer case has a housing chamber and an opening at a top end thereof;

the universal joint includes a cap and a ball seat;

the inner case assembly holds the driving mechanism and has an upper case and a lower case, the upper case having a coupling portion at one end to hold the ball seat, the coupling portion having at least one diagonal hole and a first axle hole at the bottom thereof;

the driving mechanism includes:

a rotary disc which has a first gear shaft extended form the center of the bottom thereof and a plurality of vanes;

an upper lid having a third axle hole;

a first speed-reducing set which has a first bottom disc and a plurality of first gears, the first bottom disc having a second gear shaft extended downwards from the center of the bottom thereof;

a second speed-reducing set which has a second bottom disc and a plurality of second gears, the second bottom disc having a third gear shaft extended downwards from the center of the bottom thereof;

a seat which has a housing space to hold the first and second speed-reducing sets, and a boss at the bottom thereof;

a rotary head which has a coupling trough in the center and an annular base which has at least one ridge formed on the perimeter thereof; and an axle;

the water discharge disc includes:

a pad which has a hole in the center and a plurality of water discharge struts each having a water outlet running through;

a face disc which has an anchor boss in the center and a plurality of coupling holes mating the water discharge struts; and a bottom seat which has a disc and a transmission portion in the center of the disc, the transmission portion having a plurality of annular latch grooves inside latched by the ridge of the rotary head to form chain movement.

2. The rotary shower head of claim 1, wherein the first gear shaft has a second axle hole.

3. The rotary shower head of claim 1, wherein the second gear shaft has a fourth axle hole.

4. The rotary shower head of claim 1, wherein the third gear shaft has a fifth axle hole.

5. The rotary shower head of claim 1, wherein the boss has a sixth axle hole.

6. The rotary shower head of claim 1, wherein the base has a plurality of orifices.

* * * * *